US006932278B2

(12) United States Patent
Reiter et al.

(10) Patent No.: US 6,932,278 B2
(45) Date of Patent: Aug. 23, 2005

(54) FUEL INJECTION VALVE

(75) Inventors: Ferdinand Reiter, Markgroeningen (DE); Martin Maier, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/473,501

(22) PCT Filed: Nov. 29, 2002

(86) PCT No.: PCT/DE02/04386

§ 371 (c)(1),
(2), (4) Date: Apr. 7, 2004

(87) PCT Pub. No.: WO03/064846

PCT Pub. Date: Aug. 7, 2003

(65) Prior Publication Data

US 2004/0159722 A1 Aug. 19, 2004

(30) Foreign Application Priority Data

Jan. 30, 2002 (DE) ..... 102 03 659

(51) Int. Cl.[7] ..... B05B 1/08

(52) U.S. Cl. ..... 239/102.2; 239/533.7; 239/584; 251/30.01; 251/57

(58) Field of Search ..... 239/102.1, 102.2, 239/88, 92, 533.7, 533.9, 584; 251/30.01, 57, 129.06

(56) References Cited

U.S. PATENT DOCUMENTS 4,700,678 A 10/1987 Elliott
4,955,340 A * 9/1990 Elliott ..... 123/297
5,019,119 A * 5/1991 Hare, Sr. ..... 123/500
5,063,898 A * 11/1991 Elliott ..... 239/92
5,103,779 A * 4/1992 Hare, Sr. ..... 123/90.11
6,213,414 B1 * 4/2001 Stier et al. ..... 239/584

FOREIGN PATENT DOCUMENTS

| | | |
|---|---|---|
| DE | 197 14 292 | 10/1998 |
| DE | 197 35 232 | 2/1999 |
| DE | 198 54 506 | 4/2000 |
| DE | 199 19 313 | 11/2000 |
| DE | 199 42 816 | 3/2001 |
| DE | 199 58 704 | 6/2001 |
| EP | 0 477 400 | 4/1992 |
| WO | WO 01 36812 | 5/2001 |
| WO | WO 02 38948 | 5/2002 |

* cited by examiner

*Primary Examiner*—Steven J. Ganey
(74) *Attorney, Agent, or Firm*—Kenyon & Kenyon

(57) ABSTRACT

A fuel injector for the direct injection of fuel into the combustion chamber of a mixture-compressing internal combustion engine having external ignition includes a piezoelectric or magnetostrictive actuator and a valve needle, which, via a compensation element, is in operative connection to the actuator, a valve-closure member being formed on the valve needle, which cooperates with a valve-seat surface to form a sealing seat. The compensation element is filled with a rheological liquid.

8 Claims, 1 Drawing Sheet

FUEL INJECTION VALVE

FIELD OF THE INVENTION

The present invention relates to a fuel injector.

BACKGROUND INFORMATION

Published European Patent 0 477 400 discloses a path transformer for a piezoelectric actuator in which the actuator transmits a lifting force to a master cylinder sealed by a cylinder support. Guided in this master cylinder is a slave piston, which likewise seals the master cylinder and thereby forms the hydraulic chamber. Arranged in the hydraulic chamber is a spring that presses the master cylinder and the slave piston apart. The slave piston mechanically transmits a lifting movement to a valve needle, for instance. When the actuator transmits a lifting movement to the master cylinder, this lifting movement is transmitted to the slave piston by the pressure of a hydraulic fluid in the hydraulic chamber, since the hydraulic fluid in the hydraulic chamber is not compressible and only a very small portion of the hydraulic fluid is able to escape through the ring gap during the short duration of a lift. In the rest phase, when the actuator does not exert any compressive force on the master cylinder, the spring pushes the slave piston out of the cylinder and, due to the generated vacuum pressure, the hydraulic fluid penetrates and replenishes the hydraulic chamber via the ring gap. In this manner, the path transformer automatically adapts to linear deformations and pressure-related expansions of a fuel injector.

One disadvantage of the coupler arrangement disclosed in the European Patent 0 477 400 is the high expense caused by the high manufacturing precision required for the components. Furthermore, in opening pulses that occur in close succession, the coupler medium escapes from the coupler gap and, due to the narrow width of the leakage gap, is unable to continue flowing fast enough, which means the switching dynamics of fuel injectors with hydraulic couplers is limited. German Patent No. 197 35 232 discloses the use of an electro-rheological liquid in a fuel injector, the fuel injector being provided with a damping element connected to the valve needle of the fuel injector to model the injection profile or the injected fuel quantity. In response to an excitation or de-excitation of the electromagnet, the damping element effects a flow of an electro-rheological fluid into a damping chamber via a capacitive component. With the aid of the capacitive component, the viscosity of the electro-rheological fluid is modifiable by an electronic control device as a function of operating parameters of the internal combustion engine, in such a way that the movement profile of the damping element is implemented such that the fuel spray-discharged via the spray-discharge orifice assumes a desired jet form or is spray-discharged at a desired time. The use of the rheological fluid for a compensation element for piezoelectric or magnetostrictive actuators is not described in German Patent No. 197 35 232, however.

SUMMARY OF THE INVENTION

In contrast, the fuel injector according to the present invention has the advantage over the related art that a sealed compensation element, filled with a rheological liquid, is disposed on the downstream side of the piezoelectric or magnetostrictive actuator, which, on the one hand, compensates for the slow thermal expansion of the different components of a fuel injector and, on the other hand, transmits rapid switching movements of the actuator to the valve needle as opening pulses.

The compensation element may be formed by a pot and a top, the pot being flexurally stiff and the top having a flexible design.

The top may be provided with crimps, which improve the elastic deformability of the top.

Furthermore, the pot of the compensation element may be easy to produce by deep-drawing. After filling, the top may be hermetically joined to the pot, so that it is easy to install the filled compensation element in the fuel injector as an overall component.

DETAILED DESCRIPTION

Figure 1:
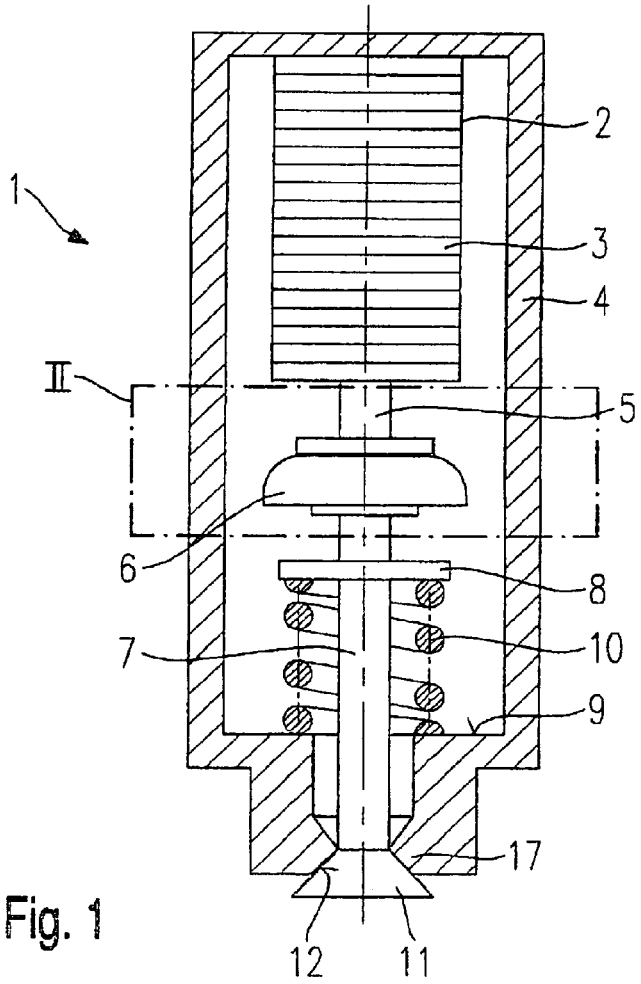
FIG. 1 is a schematic sectional view showing a section through an exemplary embodiment of a fuel injector of the present invention.

An exemplary embodiment of a fuel injector 1 according to the present invention, shown in FIG. 1, is designed for fuel-injection systems of mixture-compressing internal combustion engines having externally supplied ignition. Fuel injector 1 is suited for, among other things, the direct injection of fuel into a combustion chamber (not shown) of an internal combustion engine. Fuel injector 1 includes an actuator 2, which is made up of piezoelectric layers 3, for instance. Actuator 2 is encapsulated in a housing 4 on which actuator 2 is supported at an end face.

On the downstream side of actuator 2 is an actuating element 5, which has the shape of a piston and abuts against a compensation element 6. A detailed description of compensation element 6 and its functioning method are provided below in connection with FIG. 2.

Downstream from compensation element 6 is a valve needle 7 to which a support disk 8 is connected by force locking. Disposed between support disk 8 and a housing shoulder 9 is a restoring spring 10, which acts on valve needle 7 in such a way that a valve-closure member 11 joined to valve needle 7 is retained in sealing contact at a valve-seat surface 12. Valve-seat surface 12 may be formed on a valve-seat body 17 integrated in housing 4 of fuel injector 1.

If fuel injector 1 is energized via an electrical line (not shown further), piezoelectric layers 3 of actuator 2 expand, thereby moving actuating element 5, compensation element 6 and valve needle 7 counter to the force of restoring spring 10, in the discharge direction. Valve-closure member 11, which is in operative connection to valve needle 7, lifts off from valve-seat surface 12, thereby injecting fuel into the combustion chamber (not shown further) of the internal combustion engine.

If the energy supply to actuator 2 ceases, piezoelectric layers 3 contract, which causes restoring spring 10 to move valve needle 7, via pressure on support disk 8, counter to the discharge direction. Valve closure member 11 sets down on valve-seat surface 12, thereby closing fuel injector 1.

Figure 2:
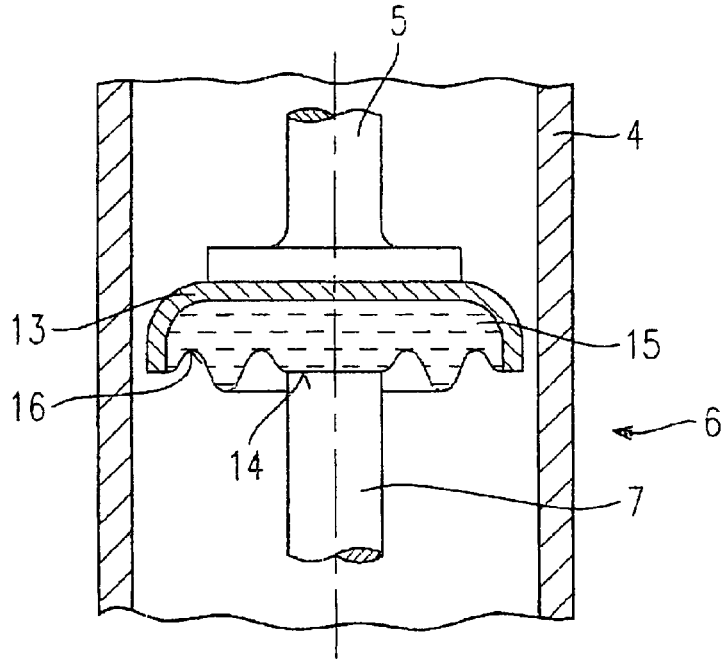
FIG. 2 is a schematic sectional view showing portion II of the exemplary embodiment of the fuel injector of the present invention shown in FIG. 1.

In an enlarged, schematic view, FIG. 2 shows the cutaway portion designated II in FIG. 1, in the region of compensation element 6.

Compensation element 6 is provided to compensate for slow linear deformations caused by thermal influences, especially of actuator 2, so that valve-closure member 11 does not lift off from valve-seat surface 12 as a result of the slow thermal expansion of actuator 2. In contrast, rapid linear deformations of actuator 2 when power is supplied to switch fuel injector 1, should be transmitted to valve needle 7.

According to the present invention, compensation element 6 is therefore made up of a cup-shaped pot 13, which may be produced by deep-drawing, for example, and a top 14, which seals pot 13 and may be joined thereto by a circumferential welded seam. Braced on pot 13 on the inflow side is a piston-shaped actuating element 5, while valve needle 7 abuts against top 14. Pot 13 is filled with a rheological fluid 15 prior to being sealed, before top 14 is mounted and pot 13 hermetically sealed.

The thickness of the material of pot 13 may be selected such that pot 13 is flexurally stiff, while the material of top 14 is selected to be thinner and thus more flexible. In addition, to further increase the flexibility of top 14, crimps 16 may be provided, which are, for example, implemented on top 14 in an annular shape. Due to the flexibility of top 14, it is possible for it to be elastically deformed in a reversible manner once various components of fuel injector 1 warm up as a result of the thermal loading during operation of the internal combustion engine, and thus undergo linear deformation.

At low loading speed, sealed-in rheological fluid 15 behaves like a liquid, i.e., top 14 is pressed into pot 13 by the mutually opposing forces of expanding actuator 2 and restoring spring 10, so that fuel injector 1 remains closed despite the thermal linear deformation. On the other hand, at high actuation speed, i.e., when actuator 2 is energized to open fuel injector 1, rheological fluid 15 behaves like a solid body so that compensation element 6 reacts in a rigid manner and transmits the lift of actuator 2 to valve needle 7.

The compensation element 6 is easy and inexpensive to manufacture. Furthermore, the functional scope of piezoelectric actuator 2 of compensation element 6 is not restricted compared to a hydraulic coupler. Whereas, in the case of a hydraulic coupler, the coupler medium between the pistons escapes when two pulses occur in-rapid succession and the intervening time is too short for a backflow, compensation element 6 with rheological liquid 15 is able to react to any opening pulses, no matter how quickly they follow one another.

The present invention is not limited to the exemplary embodiment shown and is also suited, for instance, to other types of actuators and for any other configurations of fuel injectors.

What is claimed is:

1. A fuel injector for the direct injection of fuel into the combustion chamber of a mixture-compressing internal combustion engine having external ignition, comprising:

one of a piezoelectric and magnetostrictive actuator;

a compensation element;

a valve-seat surface; and a valve needle having an operative connection to one of the piezoelectric and magnetostrictive actuator via the compensation element, the valve needle having a valve-closure member that cooperates with the valve-seat surface to form a sealing seat, wherein:

the compensation element has a pot and a top sealingly joined to the pot, the pot is flexurally stiff, the pot is flexible, and the compensation element is filled with a rheological liquid.

2. The fuel injector as claimed in claim 1, wherein the pot has a dish-shaped form.

3. The fuel injector as claimed in claim 2, wherein the thickness of the material forming the pot is selected such that the pot is flexurally stiff.

4. The fuel injector as claimed in claim 1, wherein the top is hermetically joined to the pot.

5. The fuel injector as claimed in claim 1, wherein the thickness of the material forming the top is selected such that the top is elastically deformable.

6. A fuel injector for the direct injection of fuel into the combustion chamber of a mixture-compressing internal combustion engine having external ignition, comprising:

one of a piezoelectric and magnetostrictive actuator;

a compensation element;

a valve-seat surface; and a valve needle having an operative connection to one of the piezoelectric and magnetostrictive actuator via the compensation element, the valve needle having a valve-closure member that cooperates with the valve-seat surface to form a sealing seat; wherein the compensation element is filled with a rheological liquid, wherein:

the compensation element has a pot having a dish-shaped form, the compensation element has a top, the thickness of the material forming the top is selected such that the top is elastically deformable, and the top has crimps.

7. The fuel injector as claimed in claim 6, wherein the crimps are formed on the top in an annular manner.

8. A fuel injector for the direct injection of fuel into the combustion chamber of a mixture-compressing internal combustion engine having external ignition, comprising:

one of a piezoelectric and magnetostrictive actuator;

a compensation element;

a valve-seat surface; and a valve needle having an operative connection to one of the piezoelectric and magnetostrictive actuator via the compensation element, the valve needle having a valve-closure member that cooperates with the valve-seat surface to form a sealing seat; wherein the compensation element is filled with a rheological liquid wherein:

the compensation element has a pot having a dish-shaped form, the compensation element has a top, and the top faces the valve needle of the fuel injector.

* * * * *